United States Patent [19]

Parlante

[11] Patent Number: 4,463,884

[45] Date of Patent: Aug. 7, 1984

[54] SECURITY HOLSTER FOR REVOLVER-PISTOL

[76] Inventor: Henry J. Parlante, c/o Courtlandt Bootjack Co., Inc., 270 Lafayette St., New York, N.Y. 10012

[21] Appl. No.: 533,230

[22] Filed: Sep. 19, 1983

[51] Int. Cl.[3] ..... F41C 33/02

[52] U.S. Cl. ..... 224/243; 224/193; 224/911

[58] Field of Search ..... 224/243, 242, 244, 245, 224/246, 238, 911, 912, 192, 193, 198

[56] References Cited

U.S. PATENT DOCUMENTS

| | | | |
|---|---|---|---|
| 2,001,321 | 5/1935 | Berns . | |
| 3,630,420 | 12/1971 | Bianchi | 224/243 X |
| 3,804,306 | 4/1974 | Azurin | 224/243 X |
| 3,865,289 | 2/1975 | Boren | 224/193 |
| 3,942,692 | 3/1976 | Chica | 224/243 |
| 4,084,734 | 4/1978 | Bianchi et al. | 224/192 |
| 4,273,276 | 6/1981 | Perkins | 224/243 |
| 4,303,185 | 12/1981 | Shoemaker | 224/911 X |

*Primary Examiner*—Allan N. Shoap
*Attorney, Agent, or Firm*—William T. Hough

[57] ABSTRACT

A revolver pistol holster having a trigger-guard-retaining upper rearward top wall and a W-shaped spring mounted on holster upper forward opposing side walls biasing the holster upper-forward side-wall portions toward one-another, with a central portion of the W-shaped spring being mounted against a forward wall portion connecting the side wall, such that the forward wall portion at an upper location is biased toward the trigger-guard-retaining upper rearward top wall whereby a holstered pistol is biased into a trigger-guard-retained position within the holster, and an upper forward portion of an inward side wall having a major upwardly projecting portion serving as a thumb-brace facilitatable of drawing a holstered pistol grip-handle upwardly and forwardly.

8 Claims, 7 Drawing Figures

SECURITY HOLSTER FOR REVOLVER-PISTOL

This invention relates to an improved revolver-pistol holster.

BACKGROUND

Prior to the present invention directed to providing security against malicious ripping or withdrawing of a holstered pistol from a holster worn by a law enforcement officer, there was the trigger-guard-retaining holster of the 1935 U.S. Pat. No. 2,001,321 having an open forward slit between inward and outer sides braced by a U-shaped spring having forwardly-extending legs. Likewise the 1978 U.S. Pat. No. 4,084,734 has overhanging rearward portion above the trigger guard, also with the forward holster slit. The 1971 U.S. Pat. No. 3,630,420 has a V-shaped spring in forward opposing walls of a slit-open-front holster. The 1976 U.S. Pat. No. 3,942,692 requires a leaf-spring (allowed solely on that basis) anchored in the lower forward wall with the leaf-spring biasing rearwardly an upper forward wall. While these patents are directed to mostly different objects, and exhibit some somewhat similar random structures, there remained many problems with regard to preventing malicious unauthorized drawing or ripping of a holstered pistol from its holster while concurrently retaining an easy-draw of the pistol and maintaining a neat and compact and practical holster.

OBJECTS

Accordingly, objects of the invention include the overcoming or avoiding of problems and difficulties or deficiencies of above-noted typical prior art.

More particularly, an object of the invention is to provide a holster embodying a multi-purpose spring concurrently pressing together upper-forward portions of opposing side walls of the holster, and simultaneously pressing rearwardly an upper-lip of the forward holster wall.

Another object is to provide a thumb-support facilitating upward draw of a pistol hand-grip handle.

Another object is to provide improved strength to holster walls and belt-mounting loop for improved security against unauthorized ripping of a pistol sidewardly from the holster.

Other objects become apparent from preceding and following disclosure.

One or more of the objects are obtained by the invention as disclosed in the typical illustration of the Figures intended to improve understanding, but not to unduly limit scope by these merely typical preferred embodiments.

BROAD DESCRIPTION

Broadly the invention includes a pistol holster for a typical pistol having frame, barrel, trigger guard and hand-grip handle, the holster having opposing inward and outward side walls connected to one another by a forward wall having an upper flexible upper lip-portion and by a rearward top wall located above a pistol trigger-guard of a pistol when holstered; an improvement is a dual-function spring concurrently biasing toward one another upper forward portions of the holster opposing side walls, and rearwardly biasing an upper lip of the holster forward wall, the spring being of a somewhat serpentinely-shaped, preferably W-shaped structure. The outer-legs of opposite ends of the W-spring extend preferably substantially upwardly and are mounted one on an upper portion of one of the opposite forward and outward or inner sides, and a remaining other one mounted on an upper and a remaining other one of the opposite inward and outward side walls. The upwardly-extending inside-legs of the W-shaped spring are mounted on and biasing rearwardly the above-noted upper flexible lip or lip-portion, the flex-points being at the junction of the bottom ends of the inside leg and the outside leg.

A firm rigid upwardly-extending forward portion of the holster's inward side wall provides a thumb-support portion facilitating upward or preferably obliquely forwardly and upwardly drawing of a holstered pistol by fingers gripping the hand-grip handle of the holstered revolver-pistol. Preferably a metal brace-plate mounted on the holster inward side wall extends upwardly, providing rigid bracing support to the thumb-support portion and structure. The thumb-support plate is also rigidly secured to a belt-loop by a brad or the like and/or sewn into opposing leather strips, which belt-loop preferably also includes a belt-loop brace-plate of metal. For even a new prior art holster, but particularly for old holster leather, holster leather is susceptible to being torn-away permitting unauthorized withdrawal or ripping a pistol sidewardly from a holster, tearing the holster. The rigidly secured brace plates prevent this from occurring.

The invention may be better understood by making reference to the accompanying Figures which improve understanding but are not intended to unduly limit scope which includes obvious variations and substitution of equivalents.

THE FIGURES

All FIGS. 1 through 7 disclose a common preferred embodiment.

DETAILED DESCRIPTION

As noted above, the Figures above-described, each and all illustrate a common preferred embodiment of the invention, and accordingly common indicia appear in all Figures for elements identified in more than one figure, and once described by an indicia, description is not repeated for other figures showing the same element(s).

Figure 1:
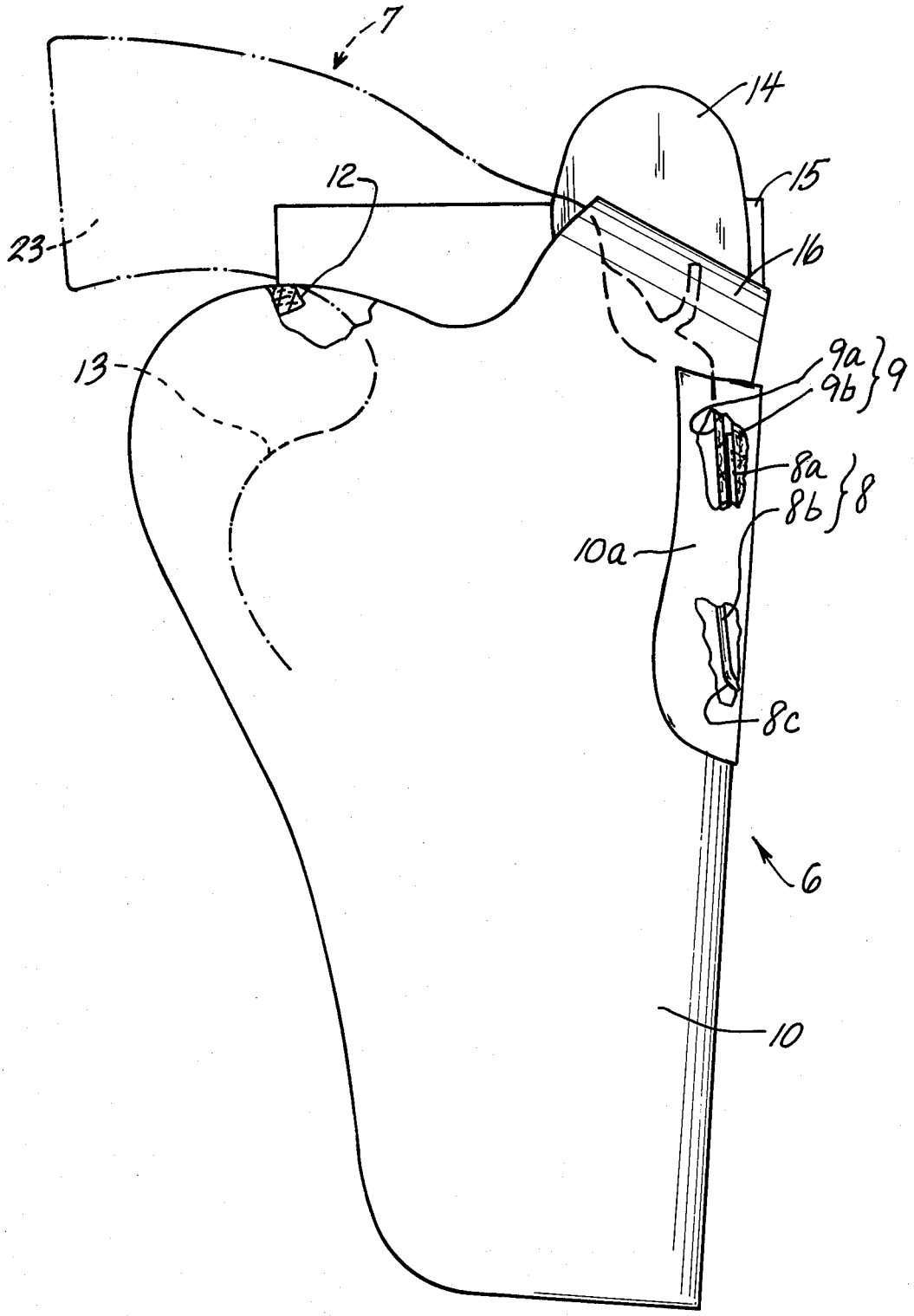
FIG. 1 illustrates in side view with partial cut-away, a preferred holster of the invention, showing in phantom the position of various parts of a holstered pistol when holstered.
Figure 2:
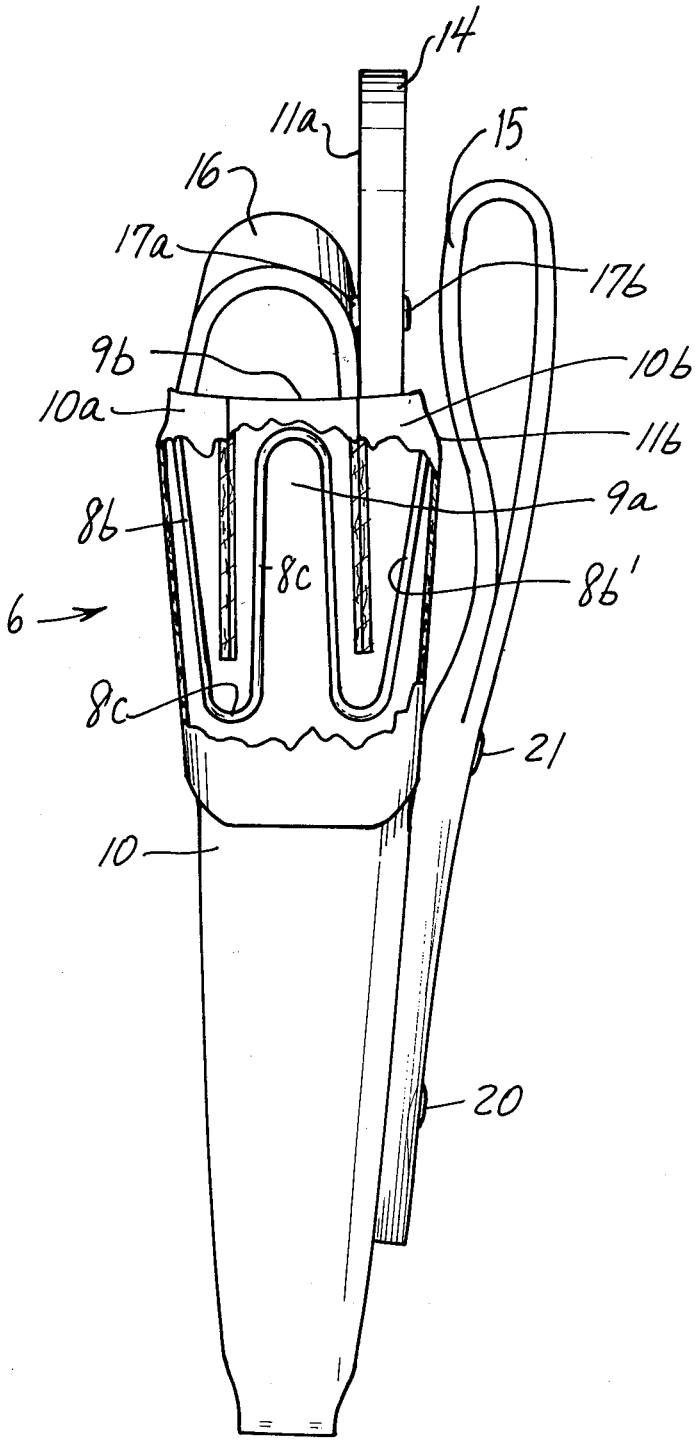
FIG. 2 illustrates a front view of the holster of FIG. 1, with partial cut-away showing the mounted spring.
Figure 6:
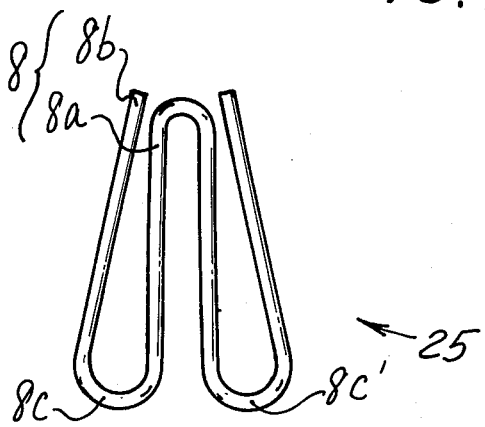
FIG. 6 illustrates an elevation plan or front view of the spring before mounting, comparable to the view thereof shown in the cut-away portion of FIG. 2.

FIG. 1 illustrates a holster 6, having outward wall 10 with outward spring-enclosing leather layer 10*a*, and revolver-pistol 7 shown in phantom in a holstered state. The rearwardly-biasing portion of the spring 8 is spring central-portion 8*a*, and the illustrated spring-leg on the outward side of the holster is outward spring-leg 8*b* of spring 8, the central-portion 8*a* flexing and biasing rearwardly at the lower junction-point location 8*c* at which the spring central-portion 8*a* and the spring-leg 8*b* are integral and continuous and joined with the spring-leg 8*b* extending substantially upwardly and leaning inwardly as best seen in FIG. 6. In the cut-away portion of outward wall 10, there may be seen the inside forward leather layer 9*a* and the outside forward leather layer 9*b* which jointly make-up the upper forward-wall lip-portion of the holster normally biased angularly rearwardly by the biasing spring central-portion 8*a* shown mounted between outward and inward forward leather layers 9*a* and 9*b* of forward-wall lip-portion 9. Forward leather layer 9*b* is continuous with spring-enclosing leather layer 10*a* as best seen in the FIG. 2 illustration. Inside forward leather layer 9*a* is continuous with the outward wall 10, as is apparent from the view of FIG. 2.

Shown also in cut-away of outward wall 10 is the top rearward trigger-guard-retaining wall 12 shown in cross-section adjacent holstering and draw space forwardly thereof and beneath it, being preventable of withdrawal of the trigger-guard 13 devoid of unlatching the snap 17 (FIG. 2) of retaining strap 16 when mere upward draw is attempted. Also viewable partially is the belt-loop structure 15, and in phantom the hand-grip handle of the holstered pistol.

In FIG. 2, the other half of the snap as snap portion 17*b* is shown in its mounted state. Also shown are brads 20 and 21. Both FIGS. 1 and 2 amply illustrate the majorly upwardly-extending thumb-bracing structure 14 as an integral forwardly upper portion of the inward side of the holster, which serves as a thumb rest upon which the thumb of a person may be braced while lifting the pistol handle by other fingers, drawing upwardly and forwardly obliquely.

While for purposes of illustration the upwardly-extending legs 8*b* and 8*b*′ appear to be parted, in fact as shown in the FIG. 6 view of the spring 25, the legs are biased inwardly in order to press toward one another the opposing outward and inward holster sides 10 and 11 (inclusive of its opposite sides 11*a* and 11*b*); such not only firms-up the fit of the holster upon a revolver-pistol holstered therein. The resiliently movable sides are (1) movable apart from one another with the lip-portion 9 anchored thereto and (2) flexible forwardly and rearwardly; this thereby provides for a looseness and greater flexibility forwardly and rearwardly of the lip-portion 9 described-above which is normally biased rearwardly as shown in FIG. 1, and also permitting it to be biased further rearwardly with the full biasing force being against any holstered revolver-pistol.

Figure 3:
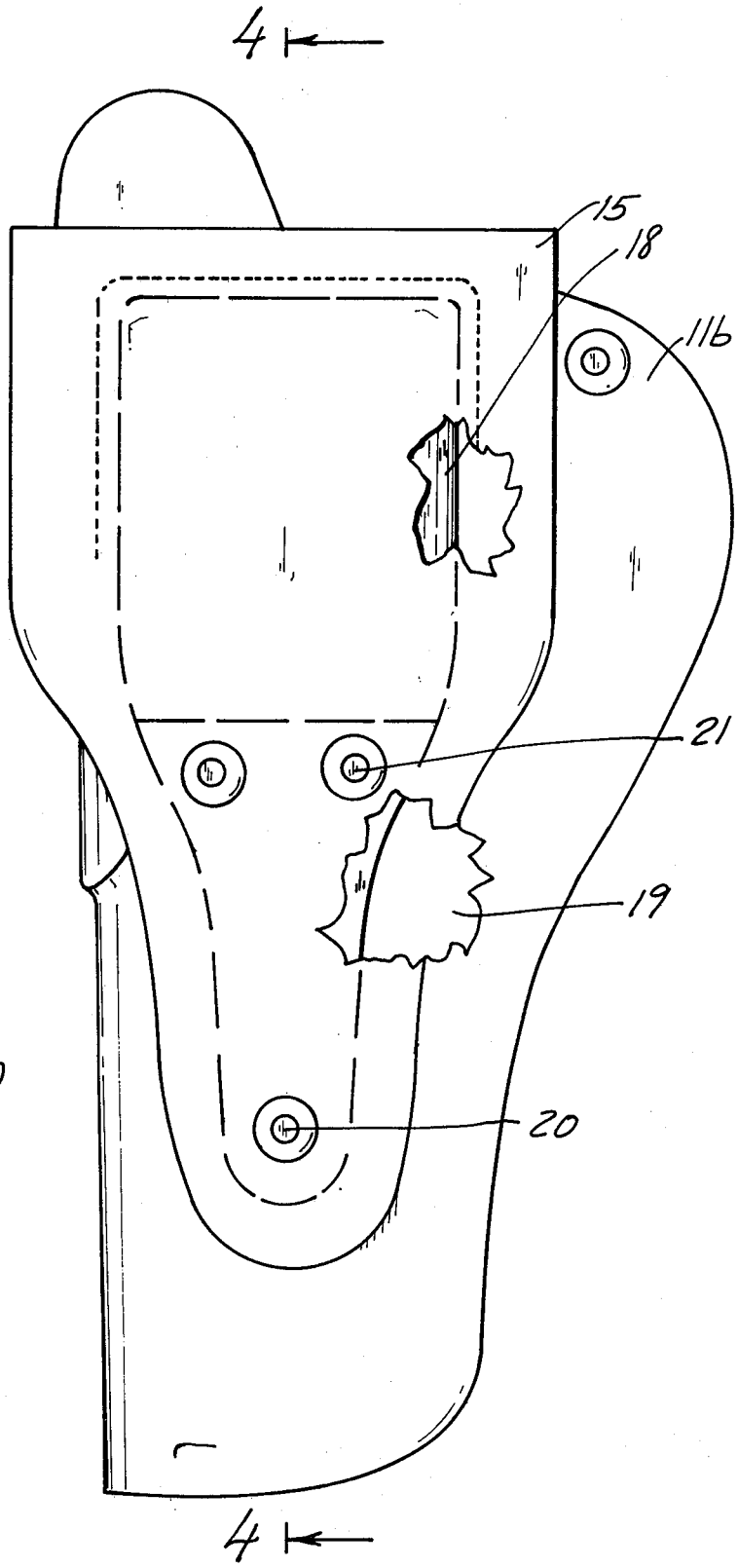
FIG. 3 illustrates a side view of the inward side of the holster, with partial cut-away showing the mounted brace-plates.

FIG. 3 illustrates a side view of the inward side of the holster of FIG. 1, illustrating additionally the inserted brace-plates 18 of the belt-loop structure 15 and 19 of the inward wall composed of wall leather sheets 11*a* and 11*b* mounted therebetween, all as anchored together by brads 20 and 21 or the like.

Figure 4:
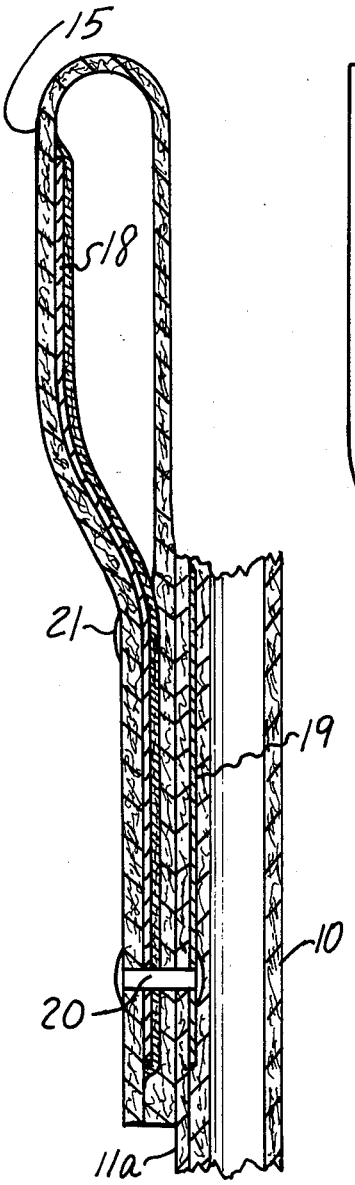
FIG. 4 is a view taken along line 4—4 of FIG. 3, showing the typical fabrication and plates arrangement in cross-sectional view.

FIG. 4 illustrates in cross-sectional view of the embodiment of FIG. 3 along line 4—4 thereof, the same features described for FIG. 3.

Figure 5:
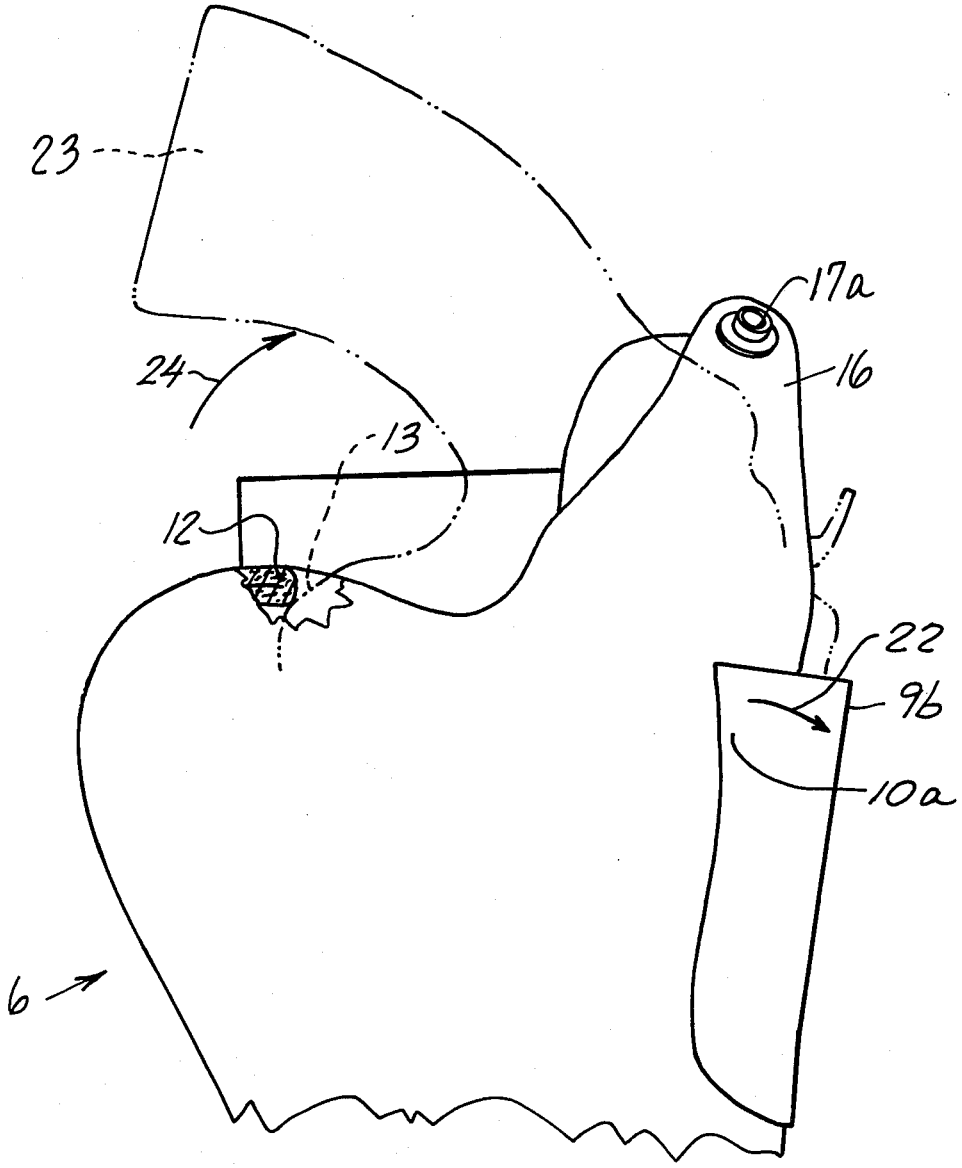
FIG. 5 illustrates an in-part view comparable to that of FIG. 1 for the same embodiment, but showing in phantom the position of the revolver-pistol during withdrawal thereof, and thus showing the rearwardly-biased spring's central portion flexed forwardly to a position permitting withdrawal of the revolver-pistol.

FIG. 5 contributes by illustrating the position of the surface 9*b*, i.e. the lip portion 9, when drawing of the revolver-pistol obliquely forwardly and upwardly in direction 24 causes the lip portion 9 to be pressed forwardly in direction 22 by forward pressure of the top of a revolver-pistol when being drawn. The FIG. 5 also accordingly illustrates how thereby the trigger-guard 13 (shown in phantom) is thus provided room in which to slip upwardly past the top rearward structure 12. Draw of the pistol of course is possible solely after unlatching snap element 17*a* of the retaining strap 16.

FIG. 6 as discussed above, discloses the inwardly-biased legs 8*a* and 8*b* which jointly are referred to upwardly-extending legs 8 of W-shaped spring 25 having each of upwardly-extending central portion legs that in this preferred embodiment are joined at their upper apex as in this embodiment, but are not essentially required to be joined, since all elements would still function when mounted in the illustrated manner, although preferred functioning would be expected from the W-shaped arrangement. It is noted, that as shown in FIG. 1, the rearward bias-torque results from the bottom-located bend at locations 8*c* and 8*c*′ respectively where the upwardly-extending legs are joined rigidly and as continuous elements with the upwardly-extending inwardly-located rearwardly-pressing legs 8*a* as shown in each of FIGS. 6 and 7.

Figure 7:
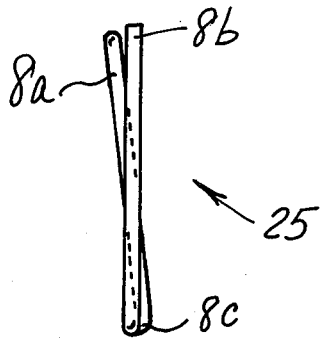
FIG. 7 illustrates a side view of the FIG. 6 spring, in a view comparable to that of the spring shown in the cut-away portion of FIG. 1.

FIG. 7 better illustrates for the spring 25 of FIG. 6, the rearward bias of the central legs 8*a* as compared to the legs 8*b* that are mounted as shown in FIGS. 1 and 2 as anchors to the inwardly-biasing spring legs 8*a*, from the flex-points here in FIG. 7 identified as 8*c* (8*c*′ not being visible in this Figure but being shown in FIG. 6).

It is within the scope of the invention to make variations and modifications and substitution of equivalents as would be apparent to a person of ordinary skill in this art.

I claim:

1. A holster for a pistol having frame, barrel, trigger guard and hand-grip handle, comprising in combination: a pistol holster having spaced-apart inward and outward side walls connected at forward and rearward edges including a forward connecting wall, and the inward and outward side walls being connected at a rearward-top location by a rearward-top wall positioned to block vertical draw of the trigger guard of the holstered pistol, and an upper portion of said forward wall at an upper location being flexible and movable in each of opposite horizontal directions forwardly and reawardly such that the pistol when holstered is drawable obliquely forwardly of said rearward-top wall when said upper portion is flexed forwardly, an improvement being a serpentinely-shaped resilient spring inclusive of at least one central upwardly-extending leg having upper and bottom opposite ends thereof, the bottom end being continuous with at least one upwardly-extending outer leg anchored in at least one of said inward and outward side walls such that upper forward portions of the inward and outward side walls are biased toward one another, and said one central upwardly-extending leg being biased rearwardly against said upper portion such that the upper portion is biased rearwardly against a pistol frame when holstered with its trigger guard beneath said rearward-top wall.

2. A holster of claim 1, in which said spring includes a second central upwardly-extending leg and a second upwardly-extending outer leg, the second central outwardly-extending leg having second upper and bottom opposite ends thereof, the second bottom end being continuous with said second upwardly-extending outer leg, said second upwardly-extending outer leg being anchored in a remaining one of said inward and outward side walls such that upper forward portions of the inward and outward side walls are biased toward one another, and said second central upwardly-extending leg being biased rearwardly against said upper portion such that the upper portion is biased rearwardly against a pistol frame when holstered with its trigger guard beneath said reaward-top wall.

3. A holster of claim 1, in which a forward upper portion of said inward side wall is substantially rigid and is shaped to extend upwardly a predetermined major distance such that a person's thumb is braceable thereon facilitatable of drawing the handle upwardly and forwardly.

4. A holster of claim 3, including a holster brace-plate mounted on said inward side wall and said forward portion thereof.

5. A holster of claim 1, in which said serpentinely-shaped spring is substantially W-shaped.

6. A holster of claim 1, including a belt-mounting closed-loop having inward and outward loop-side walls, and a loop brace-plate mounted on one of said loop-side walls and rigidly joined to said inward side wall such that the inward and outward side walls are sturdy against malicious ripping outwardly of a holstered pistol.

7. A holster of claim 6, in which a forward upper portion of said inward side wall is substantially rigid and is shaped to extend upwardly a predetermined major distance such that a person's thumb is braceable thereon facilitatable of drawing the handle upwardly and forwardly.

8. A holster of claim 6, including a holster brace-plate mounted on said inward side wall and said forward portion thereof.

* * * * *